United States Patent [19]

Guslits et al.

[11] Patent Number: 4,878,089

[45] Date of Patent: Oct. 31, 1989

[54] DEVELOPER STATION FOR A REPRODUCTION APPARATUS

[75] Inventors: Vladimir S. Guslits, Rochester; Richard A. Weitzel, Hilton, both of N.Y.

[73] Assignee: Eastman Kodak Company, Rochester, N.Y.

[21] Appl. No.: 230,936

[22] Filed: Aug. 11, 1988

[51] Int. Cl.[4] ..... G03G 15/09

[52] U.S. Cl. ..... 355/253; 118/657

[58] Field of Search ..... 355/251, 253; 118/657, 118/658

[56] References Cited

U.S. PATENT DOCUMENTS

| | | | |
|---|---|---|---|
| 3,641,977 | 2/1972 | Hudson | 118/637 |
| 4,292,924 | 10/1981 | Lindblad et al. | 118/658 |
| 4,447,518 | 5/1984 | Tabuchi | 430/122 |
| 4,449,810 | 5/1984 | Ikesue et al. | 355/3 DD |
| 4,508,052 | 4/1985 | Kohyama | 118/648 X |
| 4,633,807 | 1/1987 | Jacobs | 118/657 |

*Primary Examiner*—Arthur T. Grimley
*Assistant Examiner*—J. Pendegrass
*Attorney, Agent, or Firm*—Lawrence P. Kessler

[57] ABSTRACT

In a magnetic brush developer station for an electrostatographic reproduction apparatus, the developer station including a housing adapted to contain developer material, a mixer for such developer material, a magnetic brush for applying developer material to a charge pattern bearing member, and a mechanism for transporting developer material from the mixer to the magnetic brush. The transporting mechanism comprises a roller having members, located about the periphery of thereof, for picking up a quantity of developer material. The roller is mounted within a portion of the interior wall of the housing so as to be rotatable about its longitudinal axis. The wall portion of the housing is a segment of a cylinder whose axis is offset in relation to the longitudinal axis of the roller, so that, in the direction of rotation of the roller, the respective pickup members are closest to the wall at the entrance thereto and farthest from the wall at the exit thereto.

14 Claims, 2 Drawing Sheets

DEVELOPER STATION FOR A REPRODUCTION APPARATUS

BACKGROUND OF THE INVENTION

This invention is directed in general to developer stations for reproduction apparatus, and more particularly to an improved electrostatographic reproduction apparatus developer station wherein the transport mechanism readily meters a desirable amount of developer material to the magnetic brush applicator without material compaction.

In electrostatographic reproduction apparatus, it is general practice to apply a uniform electrostatic charge to a dielectric member and modify such charge to form a charge patterrn corresponding in image-wise fashion to information to be reproduced. The charge pattern is then developed by applying pigmented marking particles to the dielectric member. The particles, which are charged to a polarity opposite to that of the charge pattern on the dielectric member, adhere to the pattern to form a developed image on the dielectric member. The developed image is then fixed to the dielectric member, or transferred to a final receiver member and fixed thereto by heat and/or pressure for example.

One common type of electrostatographic reproduction apparatus developer station in use today is the magnetic brush developer station. Such station includes a housing providing a reservoir for a supply of developer material. The developer material may be, for example, two-component material comprising magnetic carrier particles and relatively smaller pigmented marking particles. A mechanism, such as a paddle wheel, auger or ribbon blender, is located in the reservoir and serves to stir the carrier particles and marking particle to triboelectrically charge the particles so that the marking particles adhere to the surface of the carrier particles. A transport mechanism brings the developer material into the field of a plurality of magnets which, in turn, apply the marking particles to the charge pattern on the dielectric member.

A typical transport mechanism includes a roller having a plurality of buckets located about its peripheral surface. As the roller is rotated, the buckets scoop up developer material and deliver the material to the magnetic brush (see for example U.S. Pat. No. 4,716,437, issued Dec. 29, 1987 in the name of MacLellan). While such transport mechanism has poven generally successful in operation, its arrangement may lead to several problems. Transfer of developer material from the transport mechanism to the magnetic brush may require a magnetic field of a strength which adversely effects subsequent transfer of marking particles to the charge pattern bearing member. Additionally, as the roller rotates the buckets in the developer station housing, developer material may be compacted into flakes which can cause serious image defects if applied to the charge pattern being developed.

SUMMARY OF THE INVENTION

This invention relates to a magnetic brush developer station wherein a transport mechanism is arranged to provide ready transfer of developer material to the magnetic brush and prevent compaction of developer material on delivery to the magnetic brush. In this magnetic brush developer station, which includes a housing adapted to contain developer material, is a mixer for such developer material, a magnetic brush for applying developer material to a charge pattern bearing member, and a mechanism for transporting developer material from the mixer to the magnetic brush. The transporting mechanism comprises a roller having members, located about the periphery thereof, for picking up a quantity of developer material. The roller is mounted within a portion of the interior wall of the housing so as to be rotatable about its longitudinal axis. The wall portion of the housing is a segment of a cylinder whose axis is offset in relation to the longitudinal axis of the roller so that, in the direction of rotation of the roller, the respective pickup members are closest to the wall at the entrance thereto and farthest from the wall at the exit thereto.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
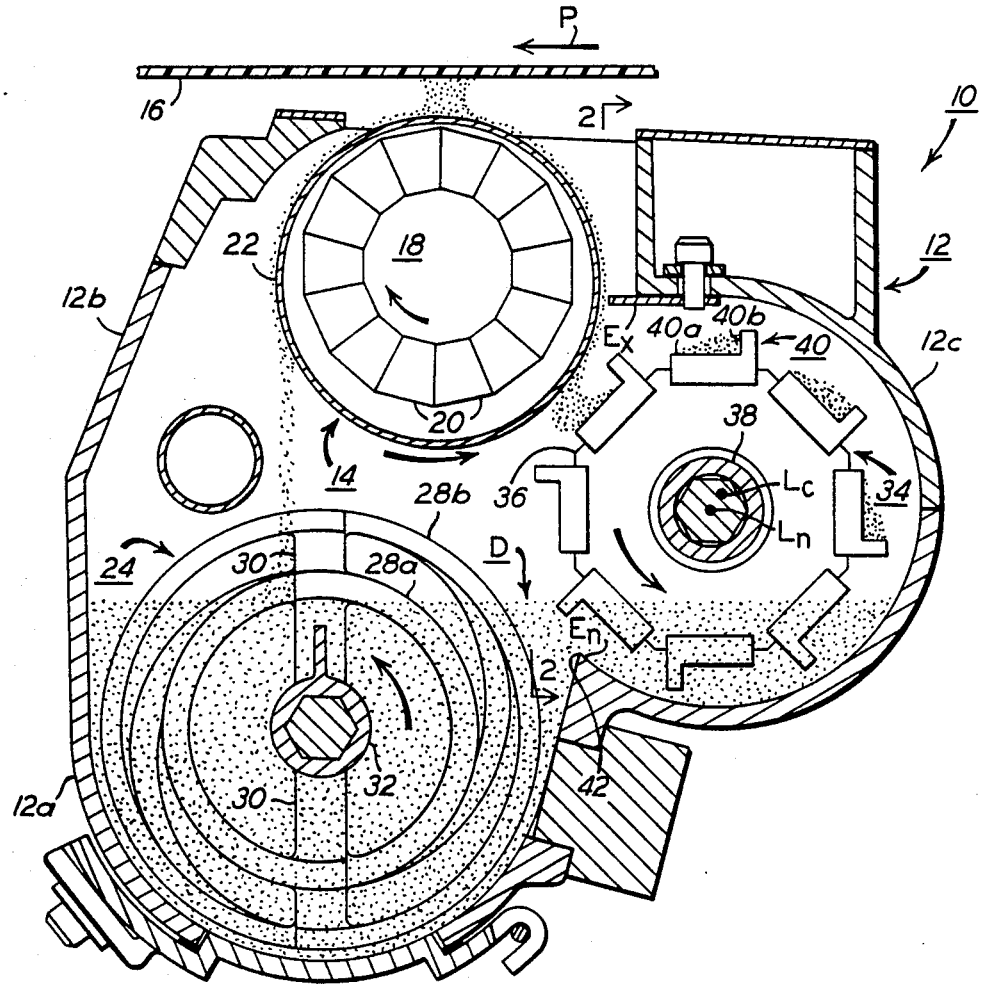
FIG. 1 is an end elevational view, in cross-section, of a magnetic brush developer station including the transporting mechanism according to this invention.

Referring now to the accompanying drawings, FIG. 1 shows, in cross-section, a magnetic brush developer station, designated generally by the numeral 10. The developer station 10 includes a housing 12 having intercommunicating portions **12*a*–12*c* including a lower portion 12a which serves as a reservoir for developer material D. The developer material is, for example, a two-component material having magnetic carrier particles intermixed with relatively smaller pigmented marking particles. Of course, a single component developer material is also suitable for use with this invention. The upper portion 12*b* of the housing 12 contains a magnetic brush 14 for applying the marking particles to charge patterns formed on a dielectric member 16 moving along a path P in juxtaposition to an opening O in the upper housing portion 12*b***.

The magnetic brush 14 includes a core 18 having a plurality of magnets 20 spaced around the peripheral surface of the core. A nonmagetic substantially cylindrical shell 22 surrounds the core 18 and has its longitudinal axis offset from the longitudinal axis of the core. Such offset has the effect of decreasing the field strength of the magnets 20 over the area of the shell 22 spaced farther from the magnets so that the developer material has less propensity to adhere to the shell in that area and returns to the reservoir. As is well known in the art, the core and/or shell can be fixed or rotatable as long as the particular arrangement causes the developer material to move in the fields of the magnets 20 into contact with the dielectric member 16. In the exemplary magnetic brush illustrated in FIG. 1, the core 18 (and the magnets 20) rotates clockwise, while the shell 22 rotates counterclockwise. An image-wise charge pattern on the dielectric member attracts marking particles from the developer material into adhering relationship with the charge pattern to develop such pattern. The developed pattern can then be subsequently transferred to a final receiver sheet and fixed thereto by heat and/or pressure, or may be fixed directly on the dielectric member.

Developer material D within the reservoir formed by the housing portion 12*a* is stirred by a mixer 24. The mixer 24 is for example a ribbon blender such as fully described in U.S. Pat. No. 4,634,286 issued Jan. 6, 1987, in the name of Pike. The ribbon blender includes an inner helical ribbon 28*a* and an outer helical ribbon 28*b* connected by means of rods 30 to a shaft 32. The shaft 32 is supported in the housing 12 for rotation about the longitudinal axis of such shaft. The pitch of the respective ribbons 28*a*, 28*b* are of opposite hand so that, as the shaft 32 rotates the ribbons, developer material is moved in opposite directions along the length of the blender, and the material is agitated to provide a triboelectric charge which causes the marking particles to adhere to the carrier particles. Of course, other types of mixers, such as paddle wheels or augers for example, are suitable for use with this invention.

Figure 2:
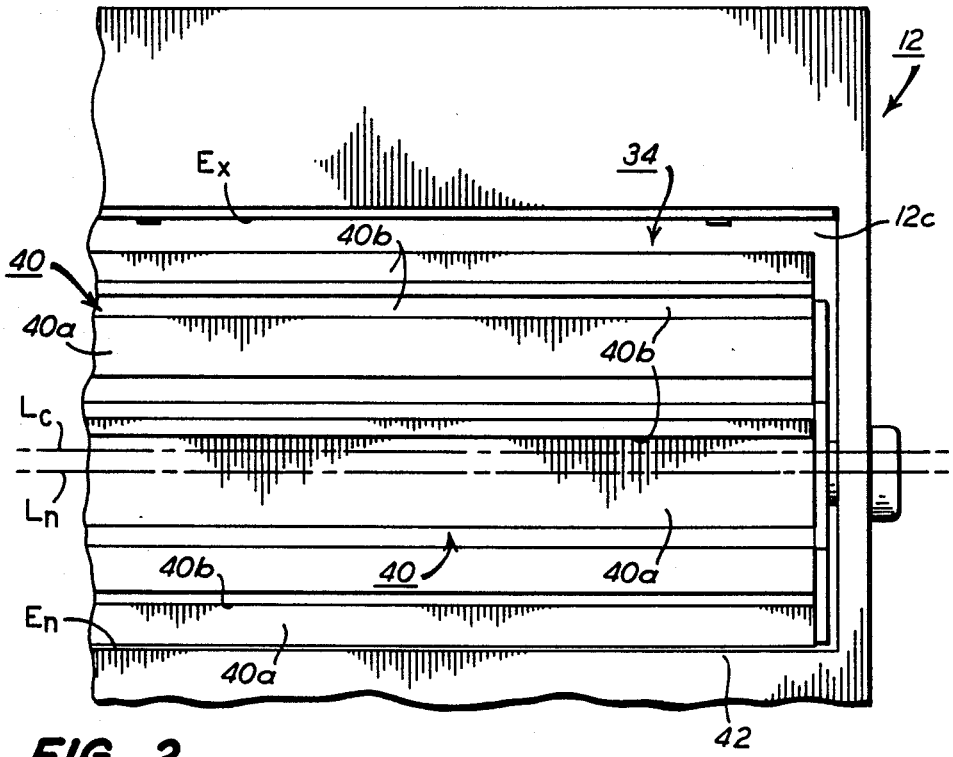
FIG. 2 is a side elevational view of the transporting mechanism of the magnetic brush developer station, looking in the direction of arrows 2—2 of FIG. 1.

The mixer 24 also moves developer material radially with respect to the mixer so that the material is moved into the portion of the housing 12 designated by the numeral 12*c*. A transporting mechanism 34, according to this invention, is located within the housing portion 12*c*. The mechanism 34, which serves to transport developer material into the field of the magnets 20 of the magnetic brush 14, includes a roller 36. The roller 36 is mounted on a shaft 38 which is, in turn, rotatably supported in the end portions of the housing portion 12*c* (see FIG. 2). A plurality of pickup members 40 are supported by the roller 36.

Figure 3:
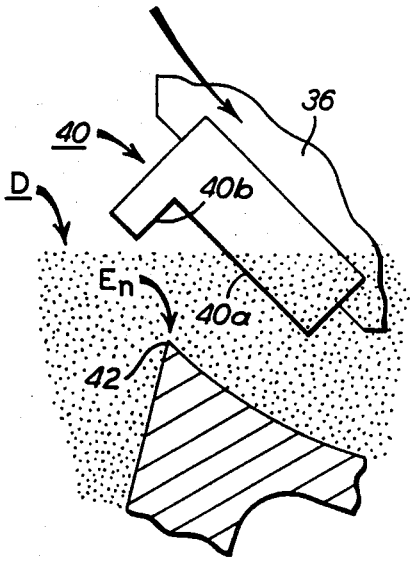
FIG. 3 is an end elevational view of a portion of the transporting mechanism of FIG. 1, on an enlarged scale, with a pickup member in its developer material pickup position.
Figure 4:
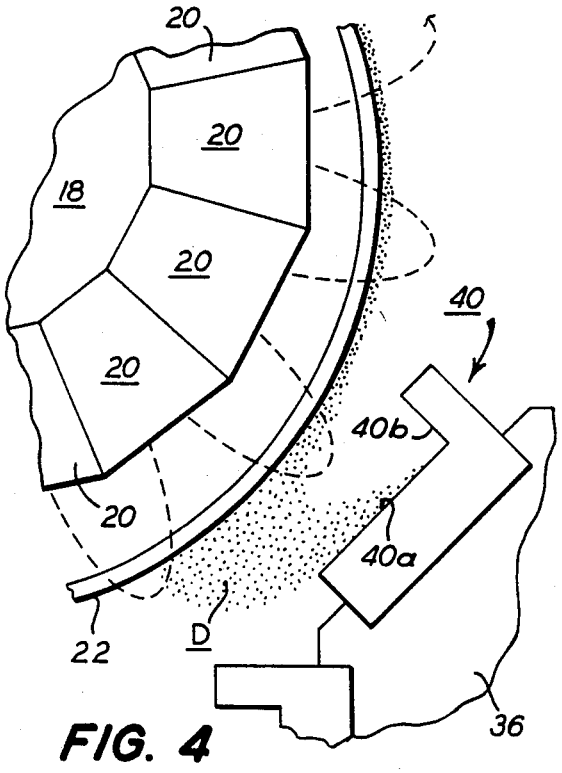
FIG. 4 is an end elevational view of a portion of the transporting mechanism of FIG. 1, on an enlarged scale, with a pickup member in its developer material delivering position.

The pickup members 40, which are located about the periphery of the roller 36 and extend respectively along the full length thereof (see FIG. 2), are in the general shape of buckets. These buckets respectively have a material supporting surface 40*a* and a radially extending scoop portion 40*b*. As the roller 36 is rotated, the pickup members move through the developer material and the scoop portions 40*b* pick up material (see FIG. 3). Such material is held on the surfaces 40*a* until the members 40 respectively pass the top dead center position for the roller 36. At that point in time, the developer material is urged by gravitational forces to fall from the members 40. Since the falling developer material is in the magnetic field of the magnetics 20 of the brush 14, the material is readily attracted to the shell 22 of the magnetic brush (see FIG. 4). This action for attracting the developer material to the shell substantially reduces the propensity of the material to become compacted as would be the case where the material is urged by the pickup members 40 into positive engagement with the magnetic brush as with magnetic brush devices of the prior art. The developer material is then moved by the magnetic brush 14 into applying relation with the charge pattern bearing member 16 in the well known manner to develop the charge pattern on such member.

The housing portion 12*c*, which is configured to have an inner wall defining a segment of a cylinder, has a portion $E_n$ located adjacent to the mixer 24 and a portion $E_x$ located adjacent to the magnetic brush 14. The longitudinal axis $L_c$ of such cylinder is offset with respect to the longitudinal axis $L_r$ of the roller 36. When the direction of rotation of the roller 36 is counterclockwise as viewed in FIGS. 1–3 of the drawings, the offset between the longitudinal axes $L_c$ and $L_r$ is in a direction such that the pickup members 40 are closest to the interior wall of the housing portion 12*c* adjacent to the portion $E_n$ thereof, and relatively substantially farther from the interior wall adjacent to the portion $E_x$ thereof. The portion $E_n$ serves as an entrance for developer material and has a sharp, well defined, lip 42 which functions as a skive for developer material scooped up by the pickup members 40. That is to say the lip 42 limits the amount of material picked up by the members 40 for transport to the magnetic brush 14. This assures that the amount of delivered material is effectively utilized by the brush. Moreover, since the distance between a respective pickup member 40 and the interior wall gets progressively larger as the member is rotated with the roller 36, the propensity for the material to become packed is substantially prevented.

The invention has been described in detail with particular reference to a preferred embodiment thereof, but it will be understood that variations and modifications can be effected within the spirit and scope of the invention.

We claim:

1. In a magnetic brush developer station for an electrostatographic reproduction apparatus, said developer station including a housing having a first portion adapted to contain developer material, a second portion containing a magnetic brush for applying developer material to a charge pattern bearing member, and a third portion containing a mechanism for transporting developer material from said first portion of said housing to said magnetic brush, said transporting mechanism comprising:

a roller;

means, located about the periphery of said roller, for picking up a quantity of developer material;

means for mounting said roller in said third portion of said housing for rotation about the longitudinal axis thereof within a portion of the interior wall of said housig in order to transport developer material from said first portion of said housing to said magnetic brush, said wall portion being a segment of a cylinder whose axis is offset in relation to the longitudinal axis of said roller so that said pickup means, in the direction of rotation of said roller, is closest to said wall at the entrance portion thereto and farthest from said wall at the exit portion thereto whereby compaction of developer material is substantially prevented.

2. The invention of claim 1 wherein said pickup means includes a plurality of buckets respectively including a material supporting surface and a radially extending scoop portion associated with said support surface.

3. The invention of claim 2 wherein said entrance portion is adjacent to said first portion of said housing.

4. The invention of claim 3 wherein said entrance portion includes a lip defining a developer material skive.

5. The invention of claim 1 wherein said exit portion is adjacent to said magnetic brush.

6. The invention of claim 5 wherein said roller is spaced from said magnetic brush a distance sufficient to enable the magnetic field of said magnetic brush to attract developer material falling from pickup means due to gravitational forces.

7. In a magnetic brush developer station for an electrostatographic reproduction apparatus, said developer station including a housing having a first portion adapted to contain developer material and a mixer for such developer material, a second portion containing a magnetic brush for applying developer material to a charge pattern bearing member, and a third portion containing a mechanism for transporting developer material from said mixer to said magnetic brush, said transporting mechanism comprising:

a roller;

means, located about the periphery of said roller, for picking up a quantity of developer material;

means for mounting said roller in said third portion of said housing for rotation about the longitudinal axis thereof wherein a portion of the interior wall of said housing in order to transport developer material from said first portion of said housing to said magnetic brush, said wall portion being a segment of a cylinder whose axis if offset in relation to the longitudinal axis of said roller so that said pickup means, in the direction of rotation of said roller, is closest to said wall at the entrance portion thereto and farthest from said wall at the exit portion thereto whereby compaction of developer material is substantially prevented.

8. The invention of claim 7 wherein said pickup means includes a plurality of buckets respectively including a material supporting surface and a radially extending scoop portion associated with said support surface.

9. The invention of claim 8 wherein said entrance portion is adjacent to said mixer.

10. The invention of claim 9 wherein said entrance portion includes a lip defining a developer material skive.

11. The invention of claim 7 wherein said exit portion is adjacent to said magnetic brush.

12. The invention of claim 11 wherein said roller is spaced from said magnetic brush a distance sufficient to enable the magnetic field of said magnetic brush to attract developer material falling from pickup means due to gravitational forces.

13. A magnetic brush developer station for an electrostatographic reproduction apparatus, said developer station comprising:

a housing having a first portion adapted to contain developer material and second and third intercommunicating portions; a mixer for such developer material located in said first portion of said housing; a magnetic brush located in said second portion of said housing for applying developer material to a charge pattern bearing member; and a mechanism for transporting developer material from said mixer to said magnetic brush, said transporting mechanism including a roller, means, located about the periphery of said roller, for picking up a quantity of developer material, and means for mounting said roller in said third portion of said housing for rotation about the longitudinal axis thereof within a portion of the interior wall of said housing in order to transport developer material from said mixer to said magnetic brush, said wall portion being a segment of a cylinder whose axis is offset in relation to the longitudinal axis of said roller so that said pickup means, in the direction of rotation of said roller, is closest to said wall at the entrance portion thereto and farthest from said wall at the exit portion thereto whereby compaction of developer material is substantially prevented.

14. The invention of claim 13 wherein said pickup means includes a plurality of buckets respectively including a material supporting surface and a radially extending scoop portion associated with said support surface.

* * * * *